US008225532B2

(12) United States Patent
Chen

(10) Patent No.: US 8,225,532 B2
(45) Date of Patent: Jul. 24, 2012

(54) SHOE AND REMOVABLY SECURABLE SHOE INSERT

(75) Inventor: Johnny Chen, Pomona, CA (US)

(73) Assignee: Pepper Gate Footwear, Inc.

( * ) Notice: Subject to any disclaimer, the term of this patent is extended or adjusted under 35 U.S.C. 154(b) by 644 days.

(21) Appl. No.: 12/370,593

(22) Filed: Feb. 12, 2009

(65) Prior Publication Data

US 2010/0199526 A1 Aug. 12, 2010

(51) Int. Cl.
*A43B 13/00* (2006.01)
*A43B 3/24* (2006.01)
*A43B 13/38* (2006.01)

(52) U.S. Cl. ..... 36/30 R; 36/15; 36/103

(58) Field of Classification Search ..... 36/103, 36/100, 101, 102, 30 R, 31, 15, 25 R, 3 B
See application file for complete search history.

(56) References Cited

U.S. PATENT DOCUMENTS

| | | | | |
|---|---|---|---|---|
| 3,204,346 | A * | 9/1965 | Lockard et al. | 36/101 |
| 4,103,440 | A * | 8/1978 | Lawrence | 36/101 |
| 4,510,702 | A * | 4/1985 | Ehrlich, Jr. | 36/86 |
| 5,083,385 | A * | 1/1992 | Halford | 36/101 |
| 5,092,060 | A * | 3/1992 | Frachey et al. | 36/29 |
| 5,661,915 | A * | 9/1997 | Smith | 36/15 |
| 6,226,894 | B1 * | 5/2001 | Bray et al. | 36/17 A |
| 6,345,454 | B1 | 2/2002 | Cotton | |
| 6,442,870 | B1 * | 9/2002 | Tsai | 36/11.5 |
| 6,560,900 | B2 * | 5/2003 | Bray et al. | 36/17 A |
| 6,976,319 | B2 * | 12/2005 | Pfander | 36/3 R |
| 7,055,265 | B1 * | 6/2006 | Bathum et al. | 36/3 B |
| 7,823,302 | B2 * | 11/2010 | Mann et al. | 36/136 |
| 7,900,379 | B2 * | 3/2011 | Lafortune | 36/100 |
| 2007/0227039 | A1 * | 10/2007 | Chaney et al. | 36/15 |
| 2007/0227040 | A1 | 10/2007 | Kilgore et al. | |
| 2007/0256330 | A1 | 11/2007 | Wallin et al. | |

FOREIGN PATENT DOCUMENTS

| | | |
|---|---|---|
| EP | 1600070 A1 | 11/2005 |
| KR | 10-0780086 | 11/2007 |
| KR | 10-07880086 | 11/2007 |
| WO | WO 98-03092 A2 | 1/1998 |

OTHER PUBLICATIONS

International Search Report and Written Opinion of the ISA, PCT/US2010/023782, Sep. 16, 2010.

* cited by examiner

*Primary Examiner* — Jila M Mohandesi
(74) *Attorney, Agent, or Firm* — Sean D. Burdick

(57) ABSTRACT

A shoe insert for adjusting the fit of a shoe on a person's foot, and the combination of such insert and a shoe with elements providing for removable securement of the insert within the shoe. The shoe insert may be formed from a stable, resilient, and biodegradable material such as a molded mixture of polyurethane and cork, and may be removably secured within the shoe via a cooperating slot and rail system to prevent slippage of the insert within the shoe. The shoe or insert or both may be contoured to provide a custom anatomical fit to the person's foot.

9 Claims, 4 Drawing Sheets

SHOE AND REMOVABLY SECURABLE SHOE INSERT

BACKGROUND OF THE INVENTION

1. Field of the Invention

The present invention relates generally to footwear, specifically to a shoe insert and a combination of a shoe and shoe insert, and more particularly to a shoe insert such as an orthotic insert which is removably securable within the shoe.

2. Description of Related Art

Numerous devices have been developed, including shoe inserts, to address the problem of poorly fitting shoes. While such devices may perform satisfactorily to some extent, devices which comprise or include inserts often fail to resolve the problem satisfactorily due to the slippage of the insert within the shoe. Such slippage of an insert within a shoe can further exacerbate a poor fitting of the shoe and result in lowered stability of the foot within the shoe, and can result in undesirable motion and harmful frictional forces acting upon the foot.

Accordingly, other devices have been developed to combat the problem of shoe insert slippage, as referenced in the prior art cited herein. Mancinelli (U.S. Pat. No. 4,503,628), for example, discloses a shoe insert which includes double faced adhesive strips to secure the insert into position within the shoe to prevent relative movement between the insert and shoe when the shoe is worm. Siesel (U.S. Pat. No. 5,842,292) discloses shoe insert art, the most relevant feature of which is simply assumed as "adhesive means" for securing an insert to the interior of the shoe, though no specific means of securing or adhering is disclosed. Collins (U.S. Pat. No. 4,642,916) discloses a "Heel Spawn" appliance which includes a non-permanent adhesive provided on a shoe-confronting surface of the lower portion of the back cover for causing the appliance to be adhered within the shoe, but it specifically contemplates only "known adhesives". Rowe (U.S. Pat. No. 1,020,160) discloses a "shoe pad" for reducing heel discomfort which is an insert for the heel area of a shoe, and which includes a "flexible facing strip" for securing the heel pad in place. Saito (U.S. Pat. No. 1,946,591) discloses a "Liner Plate for Shoes" which plate is designed to reduce friction and stocking wear, but Saito's rail is not designed to prevent interior slippage of the foot or sole insert, and the plate's tongue in Saito is simply positioned beneath a shoe's insole. Protz (U.S. Pat. No. 2,155,905) discloses a shoe insert which is detachable and adjustable and includes one or more "filler strips" made of felt or similar material which function to fill the space between a heel and the body of the heel insert, and which may be adhesively affixed to each other so as to provide adjustability via removal of one or more strips. In Protz's invention, however, it is only the surficial characteristics of the felt (or similar material) which serve to guard against interior slippage. In other prior art, various fastening methods are taught to increase fit and/or reduce foot or insert slippage, including the use of chemical adhesives and lacing.

Prior art solutions, however, fail to satisfactorily address the needs of the consumer. Inserts that are attached by adhesives cannot easily be removed, for example, to clean the shoe or to install a custom orthotic. Or, the adhesive properties or structures eventually wear out, or fail to secure the insert during prolonged usage, causing slippage of the insert and discomfort to the user. What is needed is a removable shoe insert that may be more reliably secured within the shoe.

SUMMARY OF THE INVENTION

The present invention provides an article of footwear, the article including a shoe and a sole insert, such two combinative elements being attachable to and detachable from each other. In one embodiment, a removably securable insert for insertion within the shoe includes a footbed having contoured upper and lower surfaces, and a contoured side surface separating the upper surface from the lower surface. At least one slot may be formed in the contoured side surface for engaging a cooperating rail formed within the shoe. The primary functionality of the slot and rail arrangement is to prevent interior slippage of the sole insert within the shoe while permitting convenient removal of the insert from the shoe.

These objectives may be attained through one or more of the following additional features. The upper surface of the footbed may have a greater surface area than the lower surface, and the side surface may slope from the upper surface to the lower surface. In another embodiment, the slot may be formed in a plane generally parallel to the upper and lower surfaces. The slot may have a substantially uniform depth, or may have a height between about one-tenth and about one-half the height of the side surface. In another embodiment, the insert may be formed from a molded mixture of polyurethane and cork.

In another embodiment, a removably securable insert for insertion within a shoe includes a footbed having a toe end, a heel end, contoured upper and lower surfaces, and a contoured side surface separating the upper surface from the lower surface. A first slot may be formed in the side surface and at least partially circumscribe the toe end, and a second slot may be formed in the side surface and at least partially circumscribe the heel end, so that insertion of the footbed within the shoe causes engagement of the first slot and the second slot with cooperating rails formed within the shoe.

In another embodiment, the invention provides a shoe that includes an outsole having a base layer, an inner layer disposed atop the base layer, and side walls rising above and sloping outward from the base layer and the inner layer, the side walls having an inner surface and at least one rail formed on the inner surface. In combination with the shoe, the invention further provides an insert having a footbed having contoured upper and lower surfaces, and a contoured side surface separating the upper surface from the lower surface, and at least one slot formed in the contoured side surface for engaging the at least one rail.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. In the drawings, like reference numerals may designate like parts throughout the different views, wherein:

DETAILED DESCRIPTION OF THE INVENTION

The following disclosure presents exemplary embodiments of the invention for providing a cooperating shoe and shoe insert combination that removably secures the shoe insert within the shoe. The invention may be advantageously applied in the field of custom orthotics, for example, to provide insoles having customized arch supports that conform to the structure of the bottom of a user's foot, to relieve the user from discomfort associated with fallen arches. The invention may also be advantageously applied for users with perfectly normal feet, to provide greater comfort and stability through customized or non-customized insoles.

Figure 1:
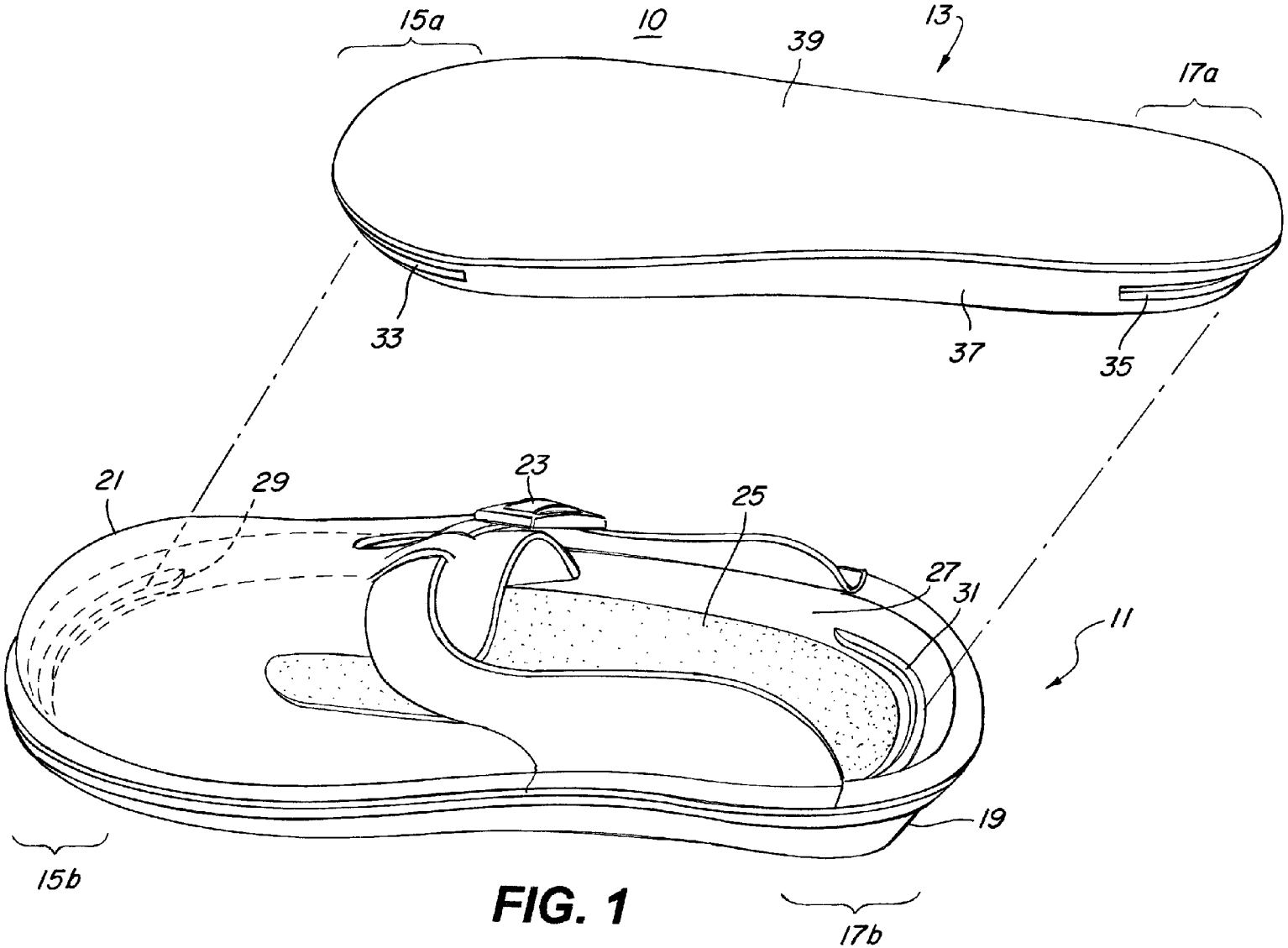
FIG. 1 is an exploded perspective view of one embodiment of a shoe and shoe insert according to the invention.

Referring now specifically to the drawings, FIG. 1 shows one embodiment of a shoe 10 according to the invention. Shoe 10 generally includes an outsole 11 and an insole, or insert 13. One or both of the outsole 11 and insert 12 may be contoured to conform generally to the shape of a human foot, as shown. Accordingly, insert 13 has a toe end 15*a* and heel end 17*a*. Outsole 11 has a corresponding toe end 15*b* and a heel end 17*b*. Insert 13 may be formed for secure insertion within outsole 1, with a means provided for removably securing the toe end 15*a* of the insert within the toe end 15*b* of the outsole, and/or means for removably securing the heel end 17*a* of the insert within the heel end 17*b* of the outsole, as indicated.

Outsole 11 may include a base layer 19, an upper portion 21, and a fastening means 23. The base layer 19 includes the sole of the shoe, and may be composed of a hard, durable material, and may also possess some resiliency. For example, in one embodiment, base layer 19 may be formed as a single piece of molded polyurethane. The upper portion 21 and fastening means 23 may be formed from any material known in the art and suitable for the purpose. For example, upper portion 21 may be composed of a leather such as suede, or from a fabric, or from plastic, or from an organic polymer such as vinyl, or from a synthetic elastomer. Fastening means 23 may be any conventional fastening means such as laces,: buttons, a hook-and-loop fastener, or a buckle as shown in the figure.

In addition to base layer 19, outsole 11 may further include a platform 25 disposed on an interior upper surface of the outsole for supporting the insert. In one embodiment, platform 25 may be composed of a non-woven fabric. Outsole 11 may further include one or more side walls 27 that rise above and slope outward from the base layer 19 and the platform 25. In one embodiment, the side walls 27 provide an inner surface on which at least one rail may be formed. According to the invention, the rail may be formed anywhere along side wall 27. Alternatively, the rail may be formed as a plurality of rails disposed along the side wall 27. The exemplary embodiment of shoe 10 provides a plurality of rails as a first rail 29 formed on the inner surface of side wall 27 at the toe end 15*b*, and a second rail 31 formed on the inner surface of side wall 27 at the heel and 17*b*. Rails 29 and 31 may be contoured to generally follow the contour of the toe and heel ends, as shown. In one embodiment, the plurality of rails may lie substantially within the same generally horizontal plane. In other embodiments, two or more rails may lie in different planes.

The rails may or may not possess substantially uniform cross-sectional areas. Generally, the dimensions and placement of the rails are selected to engage tightly within cooperating slots 33 and/or 35 that may be formed on an outer surface of insert 13.

Insert 13 generally includes an upper surface 39, a lower surface (not shown), and the side surface 37. Upper surface 39 may have a greater surface area than the lower surface, in which case the side surface 37 may slope from the upper surface to the lower surface. As with the rails formed on the outsole, one or more of the slots 33, 35 may be formed in a plane generally parallel to the upper and lower surfaces.

A slot 33 or 35 may be formed to cooperate with, and provide secure engagement with corresponding rails 29 or 31. In one embodiment, the dimensions of slots 33, 35 may have a substantially uniform depth. Generally, the dimensions and placement of slots 33, 35 are such that a user may easily lockably engage and disengage insert 13 from outsole 11 by joining the two together by hand. Side surface 37 may have a slope complementary to the slope of side wall 27, to facilitate placement of the insert within the outsole. Properly assembled, insert 13 snaps into place when one or more slots engage with one or more rails. The resilient characteristics of material used to form outsole 11 and insert 13 allow for just enough flexibility to allow a user to easily engage and disengage insert from outsole by hand and without the need for tools. When the rails and slots are engaged, the insert is securely locked within the outsole, and their mating relationship prevents the insert 13 from sliding about or becoming displaced within the shoe, even when a user is walking, running, or jumping.

In one embodiment, insert 13 may have at least one slot 33 or 35 having a height between about one-tenth and about one-half of the height of the side surface 37. The length of any slot 33 or 35 may vary from about 1 cm to the length of a single continuous slot that circumscribes the entire side surface 37. Slot depth may vary from between about 1 and about 5 mm.

The insert 13 may be formed from a durable, resilient, and moldable material that is preferably softer than the material used to construct the outsole 11. In one embodiment, insert 13 may be molded from polyurethane foam. In another embodiment, insert 13 may be formed or molded from a mixture of polyurethane and cork. Different embodiments may have different cork-to-polyurethane ratios. In one embodiment, the mixture that forms insert 13 may comprise between about 50 and about 90 percent polyurethane and between about 10 and about 50 percent cork. Preferably, an insert according to the invention may be made from these or other biodegradable materials.

Figure 2:
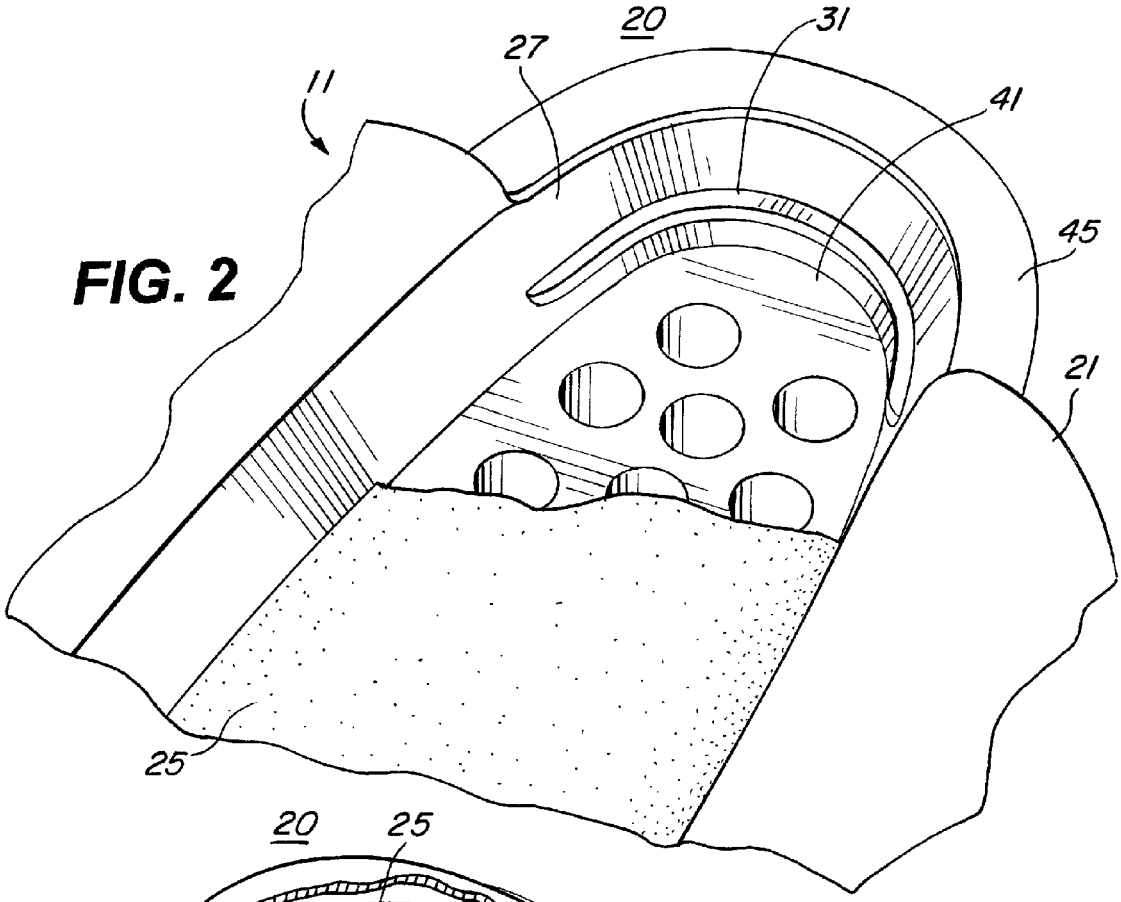
FIG. 2 is a cutaway perspective view of an interior heel portion of one embodiment of a shoe according to the invention.

FIG. 2 shows a cutaway perspective view of one embodiment of an interior heel portion of an outsole of a shoe 20 according to the invention. Platform 25 is shown partially cut away to reveal a honeycomb structure 41 formed in the bottom of base layer 19. The honeycomb structure may include a plurality of cavities 43 formed within base layer 19, which add a cushioning or spring-like quality to the shoe for greater comfort. Platform 25 may be fixed to the top surface of the honeycomb structure 41 by an adhesive such as glue or a cement. Upper portion 21 may be attached to a shelf 45 that runs along the top perimeter of base layer 19, for example, by adhesive, or threading, or both. Rail 31 is shown disposed along side wall 27, partially circumscribing the side wall along the interior of the heel end.

Figure 3:
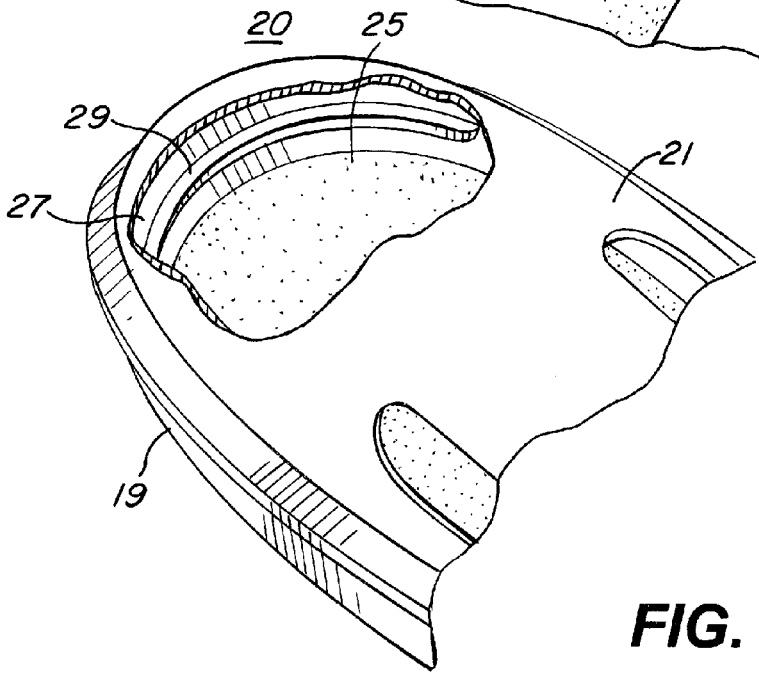
FIG. 3 is a cutaway perspective view of an interior toe portion of one embodiment of a shoe according to the invention.

FIG. 3 shows a cutaway perspective view of one embodiment of an interior toe portion of an outsole of a shoe 20 according to the invention. In this view, rail 29 is shown disposed along side wall 27, partially circumscribing the side wall along the interior of the toe end.

Figure 4:
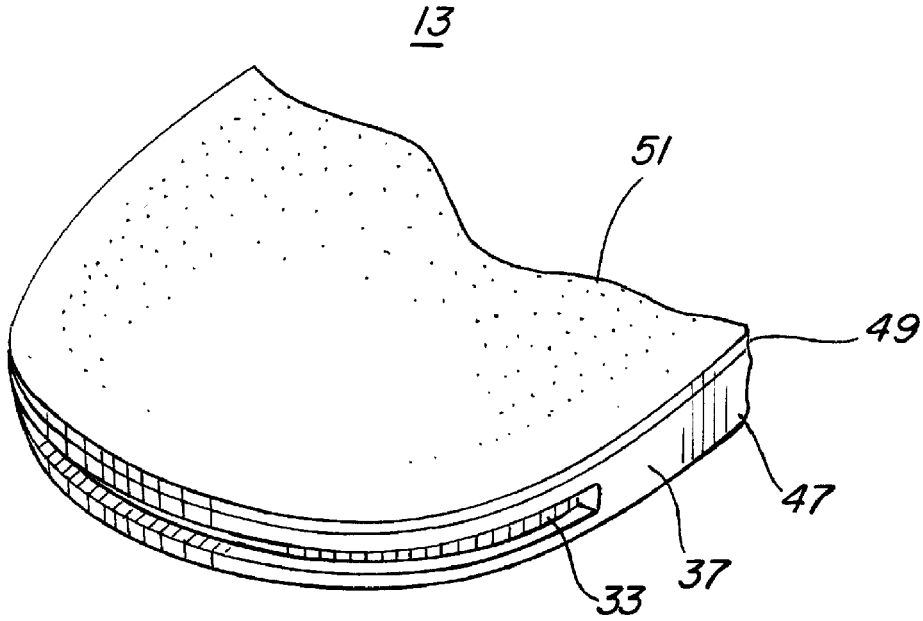
FIG. 4 is a partial perspective view of a toe portion of one embodiment of a shoe insert according to the invention.

FIG. 4 shows a partial perspective view of a toe portion of one embodiment of a shoe insert 13 according to the invention. Insert 13 may be formed from layers of several materials. A footbed 47 may form a base portion of insert 13. A padding layer 49 may be attached directly to the top of footbed 47, for example, using an adhesive. In one embodiment, padding layer 49 may be cut into a desired form from a sheet of resilient material such as latex, to provide added cushioning. A top layer 51 of a more durable material, such as fabric or leather, may be cemented to the padding layer. Slot 33 is shown partially circumscribing the toe end of the insert along the side surface 37 of insert 13.

Figure 5:
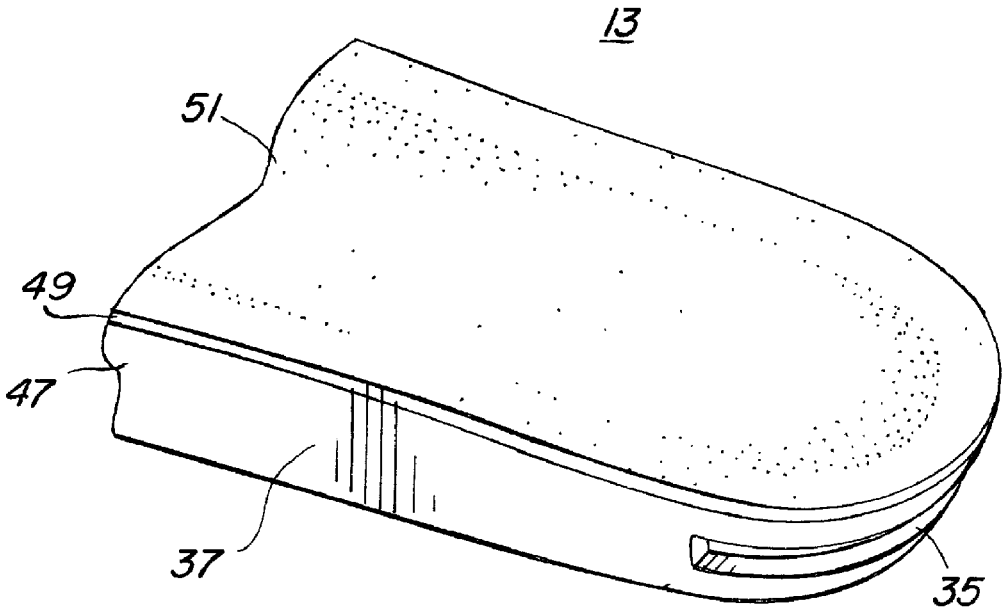
FIG. 5 is a partial perspective view of a heel portion of one embodiment of a shoe insert according to the invention.

FIG. 5 shows a partial perspective view of a heel portion of one embodiment of a shoe insert 13 according to the invention. As indicated in FIGS. 4 and 5, the upper surface 39, lower surface (not shown), and side surface 37 may be contoured, with the contoured side surface separating the upper surface from the lower surface. Slot 35 is shown partially circumscribing the heel end of the insert along the side surface 37 of insert 13.

Figure 6:
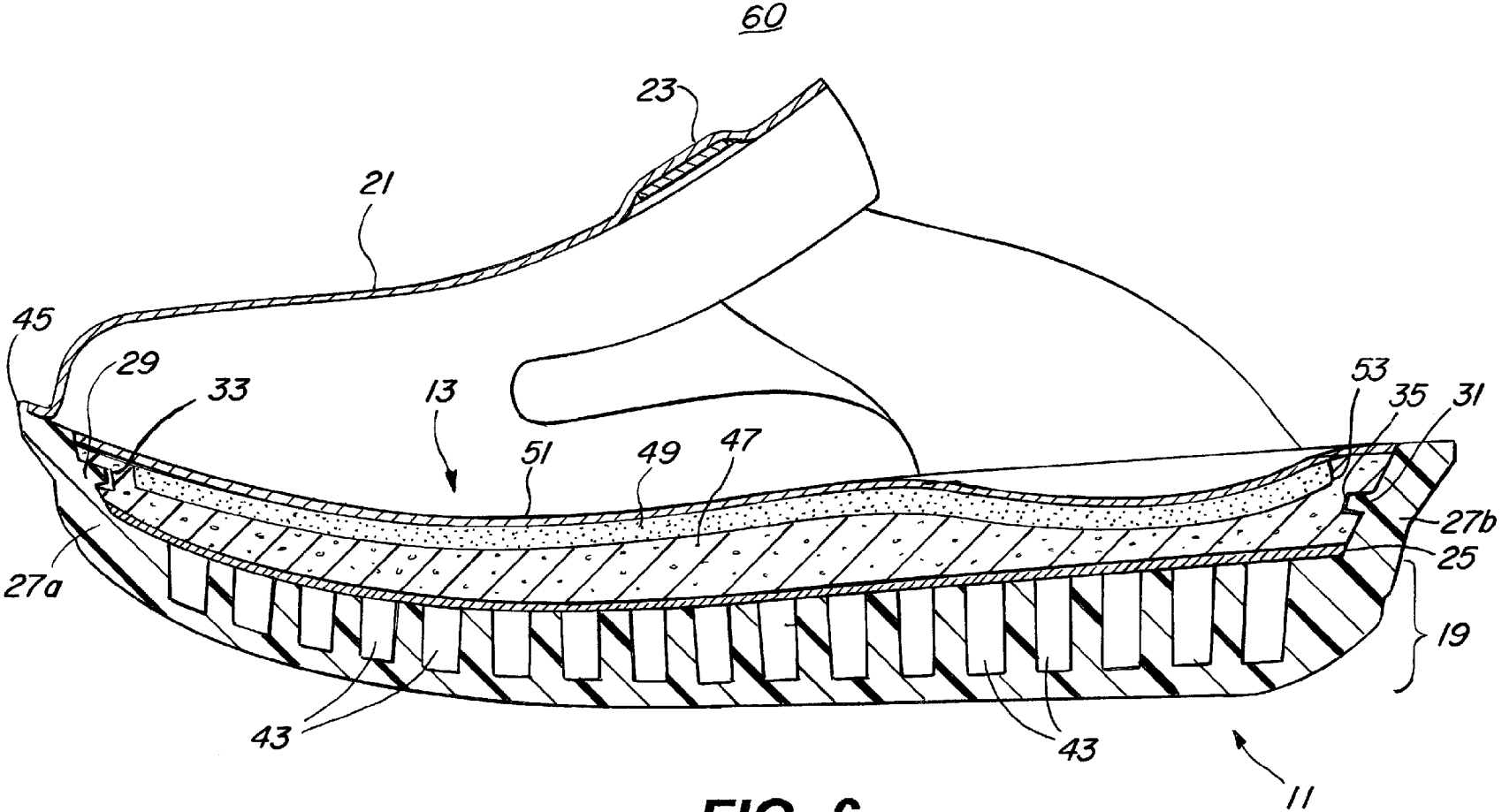
FIG. 6 is a cross sectional view of a shoe insert according to the invention engaged within a shoe according to the invention.

FIG. 6 shows a cross sectional view of a shoe 60 according to one embodiment of the invention. Shoe 60 includes an outsole 11 and an upper portion 21 with fastening means 23 fixed to the outsole 11 along a rim 45 running along the top perimeter of the outsole. A shoe insert 13 according to the invention is shown fully inserted within outsole 11 and fully engaged therein in a secured but removable position.

Outsole 11 may be molded as a single component to achieve, generally, the depicted geometry. Preferably, outsole 11 may be molded from polyurethane using a process that produces a durable yet slightly flexible base for the shoe. The thickness of base portion 19 of outsole 11 may vary from heel to toe. For example, greater thickness may be provided in the heel region, and the outsole may taper to a lesser thickness at the toe end. The heel and toe ends may be rounded or contoured longitudinally for better comfort when walking or running.

The base portion 19 may further incorporate a honeycomb structure having a plurality of cavities 43 oriented vertically within the base portion and substantially regularly displaced, as shown and as previously described. The slightly flexible characteristics of the outsole material when arranged in a honeycomb structure allow the outsole to partially deform under weight to provide shock absorption and greater comfort for the user.

Shoe 60 further depicts one possible configuration of a side wall 27. While side wall 27 may circumscribe the entire perimeter of the shoe, the cross sectional view reveals only toe and heel portions of the side wall, referred to hereafter as side walls 27*a* and 27*b*, respectively. At side wall 27*a*, a rail 29 may be formed on an inner surface of the side wall to protrude inwardly as a cantilever toward the heel end. At side wall 27*b*, a rail 31 may be similarly formed to protrude inwardly as a cantilever toward the toe end. Rails 29 and 31 may partially or entirely circumscribe the interior side wall of the outsole. In the case where the rails entirely circumscribe the outsole, rails 27 and 29 may be the same rail. In other embodiments, a plurality of rails may be disposed at different locations along the interior side wall 27.

To facilitate placement of the insert 13 into its removably secured position, side walls 27*a*, 27*b* may be formed to rise above the platform 25 and slope outward from the base layer 19. Rails 29 and 31 may be located anywhere along an inner surface of the side wall, may lie generally in the same horizontal plane, and may be configured for removably secure engagement with cooperating slots 33 and 35 formed in the insert. This configuration of sloping side walls and protruding rails helps a user guide the insert into the secured position. Using a light amount of force, a user may easily push the insert fully into the toe end of the outsole, engaging rail 29 within slot 33, and then press the heel end of the insert downward, causing it to flex as it moves past rail 31 until it securely snaps into place when rail 31 engages slot 35. To remove the insert, the user may easily pry the insert free by grasping and pulling it anywhere along its heel area.

An insert 13 according to the invention may be constructed from multiple layers of material. In one embodiment, insert 13 may include a footbed 47, a padding layer 49, and a top layer 51, as previously described. Footbed 47 may be preferably formed by molding polyurethane, or a mixture of polyurethane and another biodegradable resilient material such as cork. Footbed 47 may include a recess 53 formed within its upper surface. The padding layer 49 may then be sized to fill the recess, and fixed therein, for example, using an adhesive. In one embodiment, padding layer 49 may be cut from a latex sheet. The top layer 51, which may be a fabric or leather, covers the padding layer 49 and may also be attached thereto by a bonding agent. The upper, lower, and side surfaces of insert 13 may be contoured, as desired, to optimize the mating relationship of the insert and outsole, and to improve: comfort for the user. For example, the upper surface may be contoured to conform generally, or in the case of a custom orthotic, very specifically, to the shape of the bottom of a user's foot. The lower surface may be contoured to follow the same contour provided by platform 25 on which the insert rests. The side surfaces of the insert may slope from the upper surface to the lower surface, and, when viewed from above, may be contoured generally as an outline of the human foot.

According to the foregoing disclosure, in one embodiment of the present invention, a combination shoe and shoe insert: may include a shoe comprising-an outsole having a base layer, a platform disposed atop the base layer, and side: walls rising above and sloping outward from the base layer and the inner platform, the side walls having an inner surface and at least one rail formed on the inner surface and an insert having contoured upper and lower surfaces, and a contoured side surface separating the upper surface from the lower surface, and at least one slot formed in the contoured side surface for engaging the at least one rail. The insert may further include a footbed, a recess formed in an upper surface of the, footbed, a resilient layer attached within the recess, and a top layer covering the resilient layer.

Exemplary embodiments of the invention have been disclosed in an illustrative style. Accordingly, the terminology employed throughout should be read in an exemplary rather than a limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A shoe, comprising:

an outsole having a base layer;

a platform disposed atop the base layer; and side walls rising above and slanting outward from the base layer and the platform, the side walls having an inner surface and at least one rail formed on the inner surface; and a removable insert having contoured upper and lower surfaces, and a slanted side surface separating the upper surface from the lower surface, wherein the upper surface of the insert has a greater area than the lower surface, and the side surface of the insert slants from the upper surface to the lower surface; and at least one slot formed in the slanted side surface which engages the at least one rail so that when the rail and the slot are engaged, the insert is removably locked within the outsole.

2. The shoe of claim 1 wherein the base layer comprises a honeycomb structure.

3. The shoe of claim 1 wherein the platform comprises a non-woven fabric.

4. The shoe of claim 1 wherein the insert further comprises a footbed;

a recess formed in an upper surface of the footbed;

a resilient layer attached within the recess; and a top layer covering the resilient layer.

5. The shoe of claim 4 wherein the resilient layer comprises latex and the top layer comprises leather.

6. The shoe of claim 1 wherein the at least one slot is formed in a plane generally parallel to the upper and lower surfaces.

7. The shoe of claim 1 wherein the at least one slot has a substantially uniform depth.

8. The shoe of claim 1 wherein the at least one slot has a height between about one-tenth and about one-half of a height of the side surface.

9. The shoe of claim 1 wherein the footbed comprises a mixture of polyurethane and cork.

* * * * *